US007749092B2

(12) United States Patent
Rutherford

(10) Patent No.: US 7,749,092 B2
(45) Date of Patent: Jul. 6, 2010

(54) DEVICE FOR PRACTICING PUTTING WITH MAGNETIC AND ELECTROMAGNETIC BALL RETURN

(76) Inventor: Lamar Anthony Rutherford, 5460 White Oak Ave., #C338, Encino, CA (US) 91316

( * ) Notice: Subject to any disclaimer, the term of this patent is extended or adjusted under 35 U.S.C. 154(b) by 29 days.

(21) Appl. No.: 12/151,349

(22) Filed: May 6, 2008

(65) Prior Publication Data

US 2009/0280918 A1 Nov. 12, 2009

(51) Int. Cl.
*A63B 69/36* (2006.01)
*A63B 37/04* (2006.01)
*A63B 37/08* (2006.01)

(52) U.S. Cl. ..... 473/163; 473/161; 473/354; 473/359

(58) Field of Classification Search ..... 473/150–197, 473/351, 354, 359, 372, 373
See application file for complete search history.

(56) References Cited

U.S. PATENT DOCUMENTS 3,134,934 A * 5/1964 Brandell ..... 335/219
3,685,833 A * 8/1972 Jack, Jr. ..... 473/151
3,690,673 A * 9/1972 Occhipinti ..... 473/160
3,892,412 A * 7/1975 Koo ..... 473/160
4,447,059 A * 5/1984 Czajkowski ..... 473/153
5,102,141 A * 4/1992 Jordan ..... 473/163
5,301,947 A * 4/1994 Kim ..... 473/153
5,441,265 A * 8/1995 Codlin ..... 473/160
6,056,645 A * 5/2000 Servatius ..... 473/161
7,465,237 B1 * 12/2008 Shoemaker ..... 473/265
2008/0045358 A1 * 2/2008 VanDelden ..... 473/376
2008/0214318 A1 * 9/2008 Xie ..... 473/158
2008/0254913 A1 * 10/2008 Morgan ..... 473/360

* cited by examiner

*Primary Examiner*—Mark S Graham
(74) *Attorney, Agent, or Firm*—Ronald C Capossela

(57) ABSTRACT

A device for practice putting of golf balls is provided comprising a platform covered by a synthetic matting simulating a putting surface 2, a standing area 1 for the golfer with first 16 and second 19 foot operated electrical on/off switches for operating an electromagnetic return means such that the golfers can retrieve each golf ball without ever changing their putting position.

13 Claims, 5 Drawing Sheets

DEVICE FOR PRACTICING PUTTING WITH MAGNETIC AND ELECTROMAGNETIC BALL RETURN

CROSS REFERENCES TO RELATED APPLICATIONS not applicable

FEDERALLY SPONSORED RESEARCH not applicable

FIELD OF THE INVENTION

The present invention relates to a putting green which allows the golf ball to be returned to a starting position using a magnetic or electromagnetic ball return. More specifically, the present invention relates to a golf ball having a metallic center core that allows for the golf ball to become magnetized and be attracted to a ball return system which facilitates the user in performing putting practice such that each golf ball is returned to the golfers who does not have to leave their putting position.

BACKGROUND OF THE INVENTION

The rich history of the game over the past 200 years reveals that there have been hundreds of different putter designs. In recent years the design of the putter has taken front stage in the golf equipment industry. If the result is improving putting, the best players in the world are willing to move beyond traditional thinking in choosing the traditional method of putting practice. Most modern golf pros suggest that to putt reliably you need to train your instincts to feel automatically relaxed every time you putt. Recommended practice routines typically include elements of full-swing practice, putting practice, chipping and strength training to achieve better results and scores. A good practice routine requires at least 60% of your time on putting. This is the area that will allow a golfer to shoot lower scores no matter what level of skill the golfer achieves as it will always be of great benefit to be efficient around the greens.

Popular methods of putting practice consist of dropping several balls on a putting surface, putting towards the hole, walking to your golf balls, collecting your golf balls and returning to your putting position. During the time spent gathering your golf balls you have already forgotten the feel of your putt, how the ball rolled and the force used. However, to efficiently get results you must perform the act of putting over and over and have a familiar routine when putting. This may be done by constantly having a golf ball ready to putt.

SUMMARY OF THE INVENTION

It is an object of the present invention to provide a putting green with a golf ball return and a golf ball construction having an inner metallic core to allow for the attraction to the ball return using an electromagnetic field.

It is further an object of the present invention to provide a set of adjustable mounds within the putting green to allow for slope adjustment.

It is further an object of the present invention to provide a means to direct the golf ball from the cup to the return channel if the putt is made and electromagnetic means to direct the golf ball to the return channel if the putt is missed.

It is further an object of the present invention to provide a golf ball constructed of an outer dimpled insulated shell, a metallic inner core, and a balancing fluid positioned within the outer shell and about the metallic inner core to provide for smooth rolling of the golf ball. The metallic inner core allows the golf ball to be attracted to the electromagnetic field generated by the instant invention.

The advantages of the invention will become apparent from the study of the following description and the accompanying drawings. It should be understood that variations may be made in the details and general features of the design without departing from the spirit and scope of the invention. For example, the platform could be made of any geometric shape, e.g. circular, triangular or trapezoidal. The putting surface could be made of any material that would simulate a putting surface, e.g. indoor/outdoor carpeting, matting or "Astroturf".

DETAILED DESCRIPTION OF THE INVENTION

Figure 1:
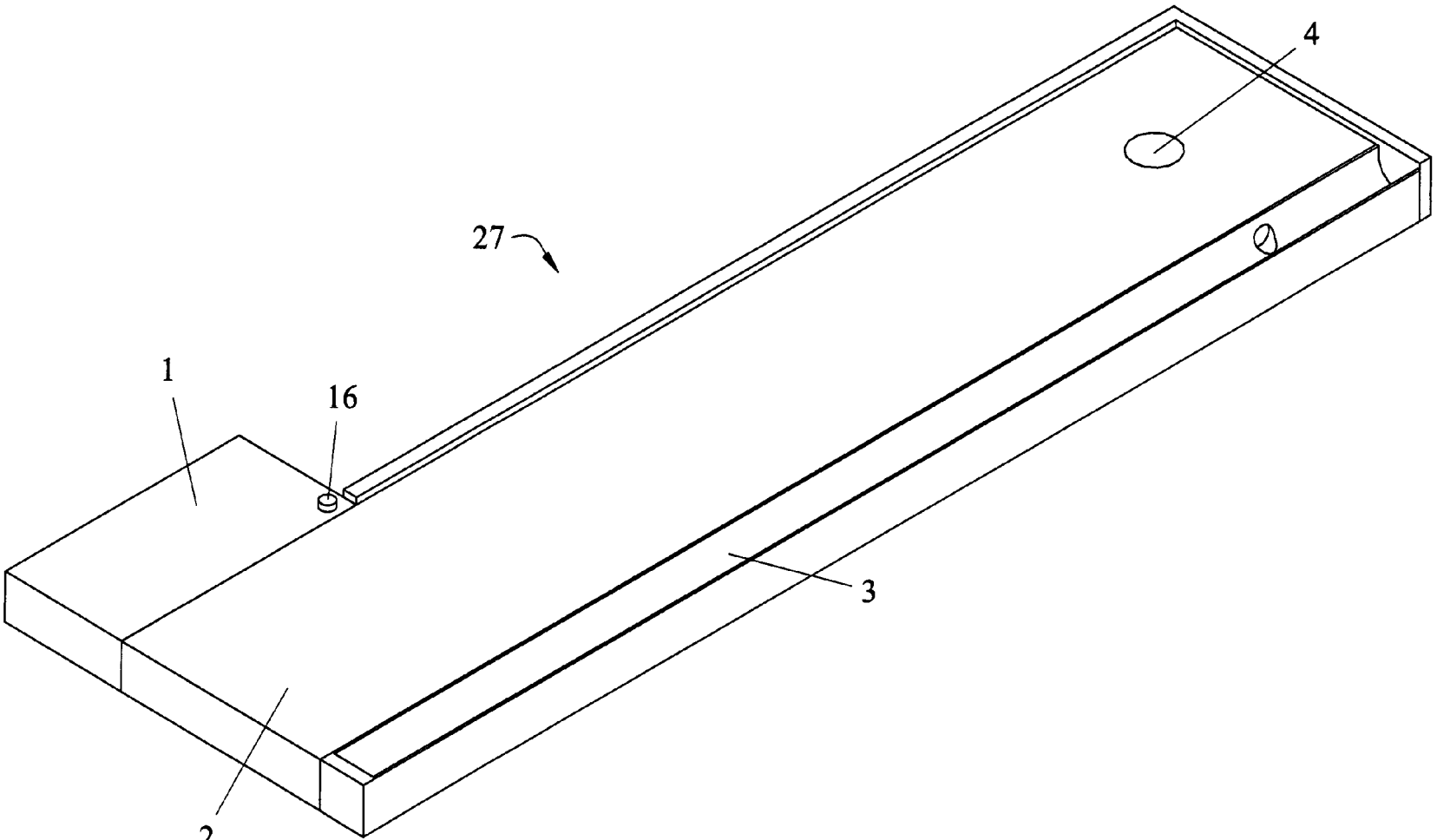
FIG. 1 is a perspective view of the practice putting device having a simulated putting surface including a cup and a standing area.

FIG. 1 shows the overall combination of the practice putting device 27 of the present invention including a platform 2 having a simulating putting surface, a standing area 1, a cup 4 and return channel 3.

Figure 2:
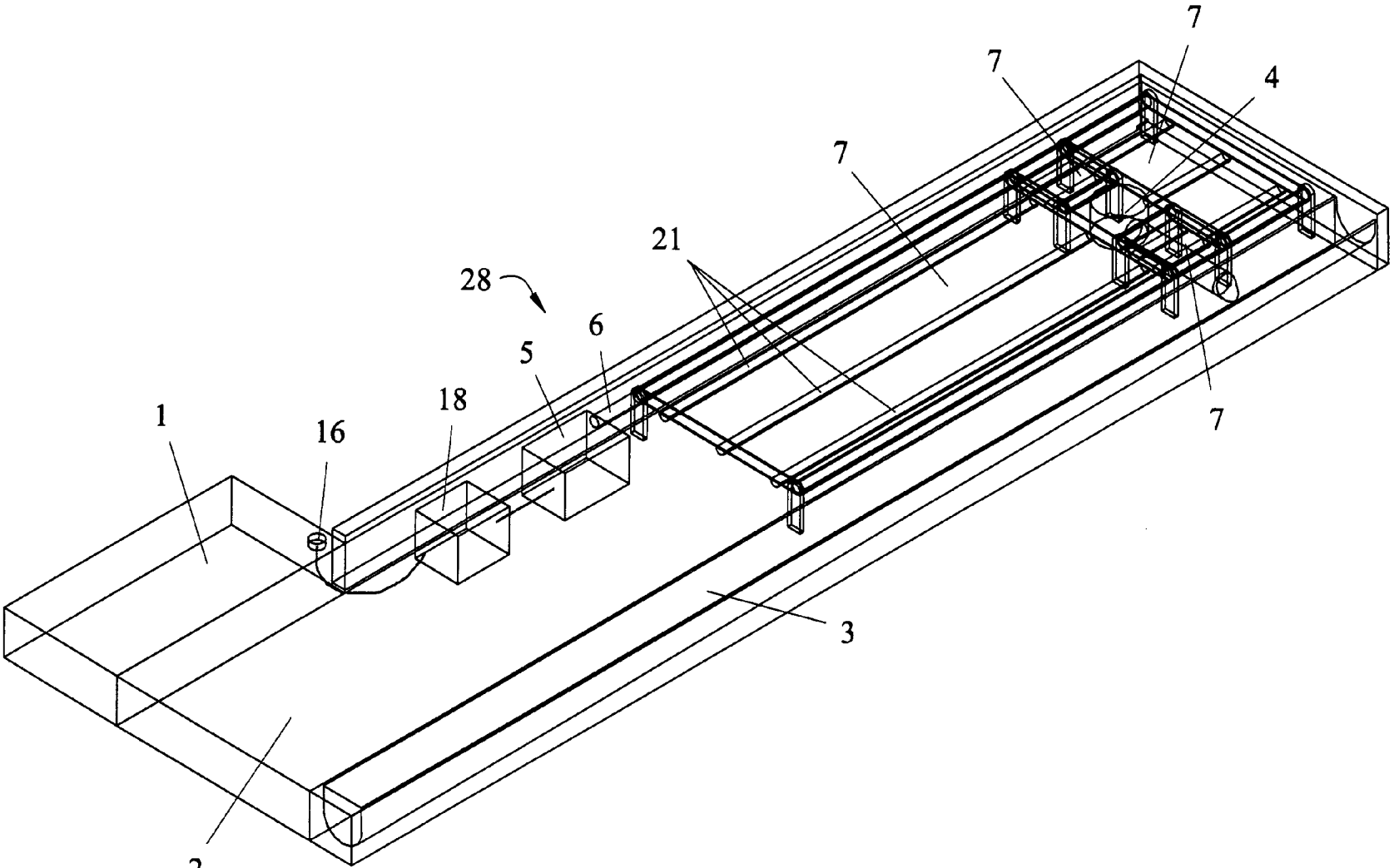
FIG. 2 is a perspective view of one embodiment of the invention showing a magnetic conveyor belt positioned below the putting surface.

FIG. 2 shows a cutaway view of the putting device 28 wherein the putting surface has been removed to show the magnetic means. Conveyor belt 7 has a plurality of flat magnetic strips 21 position thereon. When the golfer putts the golf ball into the cup 4, conduit means 17 is provided to direct the golf ball to the return channel 3. Once the golf ball is in the return channel 3 the golf ball will roll by gravity down the return channel 3. If the golfer misses the putt the golf ball will remain on the putting surface until the golfer energizes the belt by pressing the first foot operated electrical on/off switch 16. This energizes power supply 18 which rotates drive rod 6 moving the conveyor belt 7 towards the return channel 3. The golf ball is attracted to the magnetic strips 21 due to the metallic inner core 26 shown in FIG. 5. As the golf ball is deposited into the return channel 3 the power supply 18 will be de-energized and the golf ball will roll back to the golfer down the return channel 3 by gravity. Once the golf ball has returned to the proximal end of the return channel 3, the golfer has to only drag the golf ball with his putter to the standing area 1.

Figure 3:
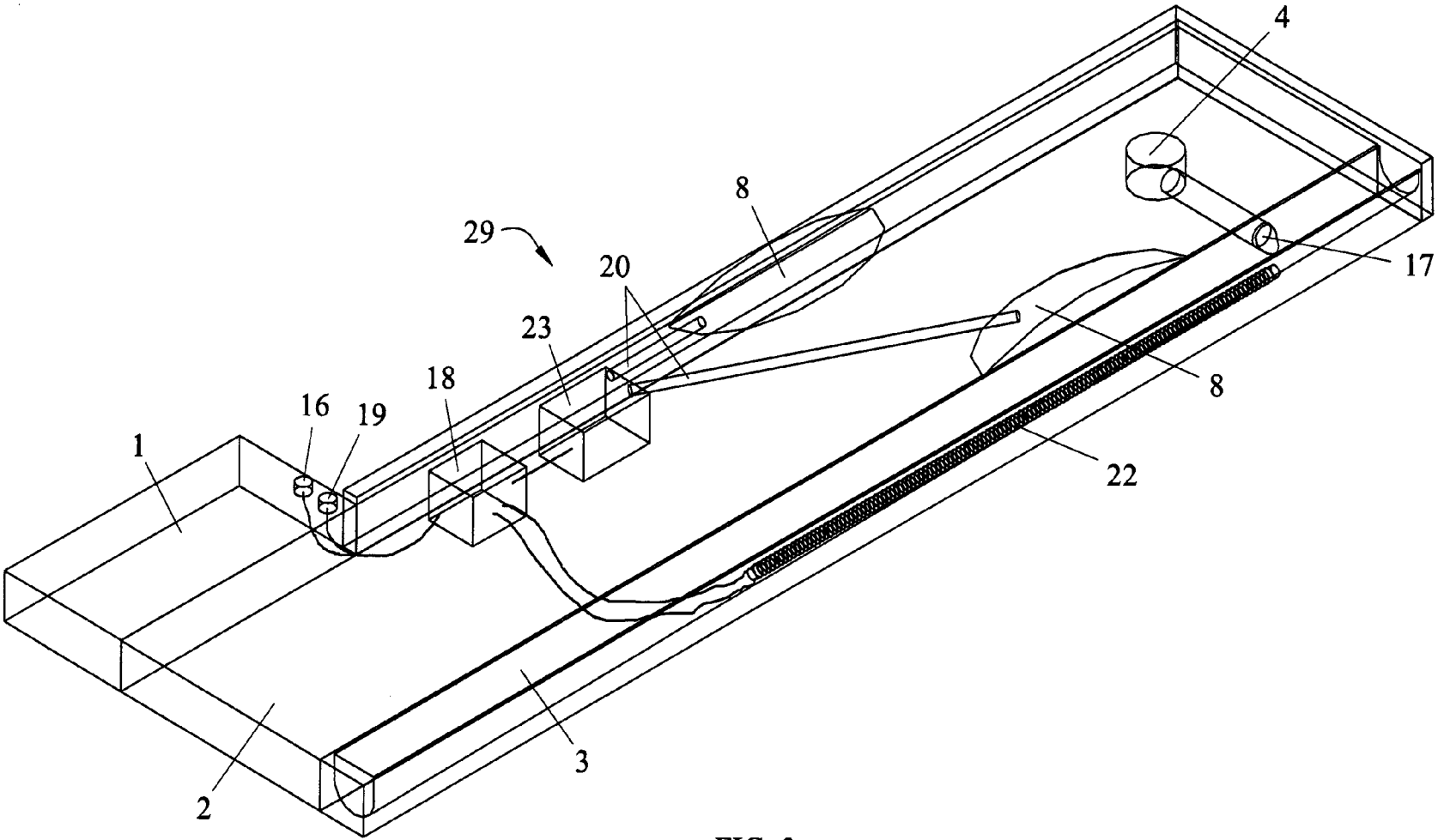
FIG. 3 is a perspective view of another embodiment of the invention wherein the electromagnetic coil is positioned within the return channel.

FIG. 3 is a perspective view of an alternative embodiment of the putting device 29 where the surface has been removed to show an electromagnetic coil 22 positioned within the return channel 3. When the golfer makes the putt the golf ball will be directed to the return channel 3 via conduit means 17. If the golfer misses the putt, the golfer simply presses the first foot operated electrical on/off switch 16 and energizes electromagnetic coil 22 positioned within the return channel 3. This will attract the golf ball to the return channel 3 due to the golf ball's magnetic properties. In addition air bladders 8 can be inflated by the golfer by pressing a second electrical on/off switch 19 energizing mini-compressor 23 and directing air from the compressor 23 to the bladders 8 via air distribution conduits 20. This feature allows the golfer to change the contour of the putting surface without ever moving from his putting position.

Figure 4:
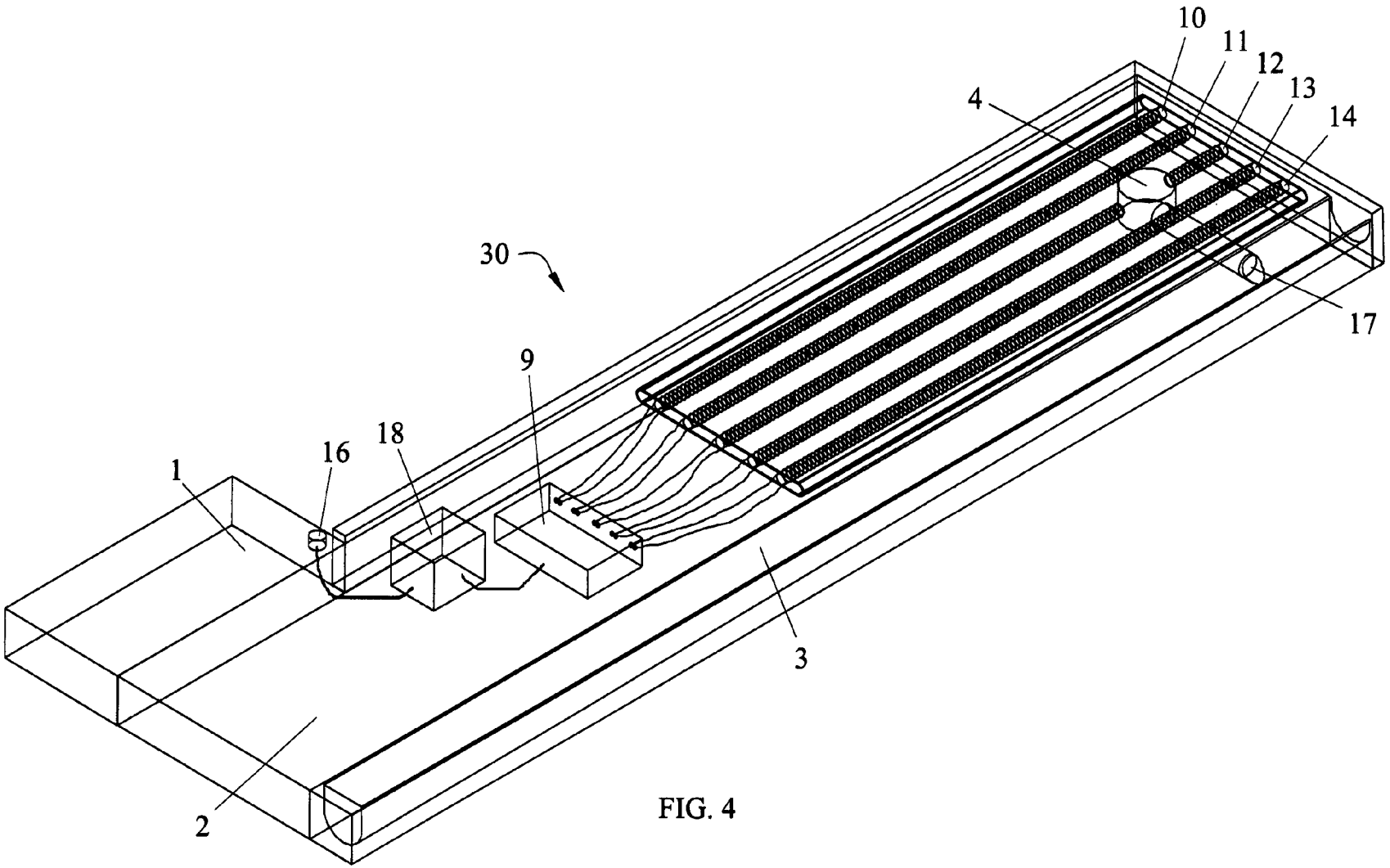
FIG. 4 is a perspective view of another embodiment wherein a sequencing relay module is used to sequentially energize a series of electromagnetic coils.

FIG. 4 shows a cutaway view of another embodiment of the putting device 30 where the putting surface has been removed to show a plurality of electromagnetic coils 10-14 and a sequencing relay module 9. If the golf ball remains on the putting surface, the golfer merely presses the first foot operated electrical on/off switch 16 and energizes sequencing relay module 9 for sequentially energizing each electromagnetic coil 10-14 in order in such a way that the golf ball is attracted to each coil in sequence as it moves toward the return channel 3.

Figure 5:
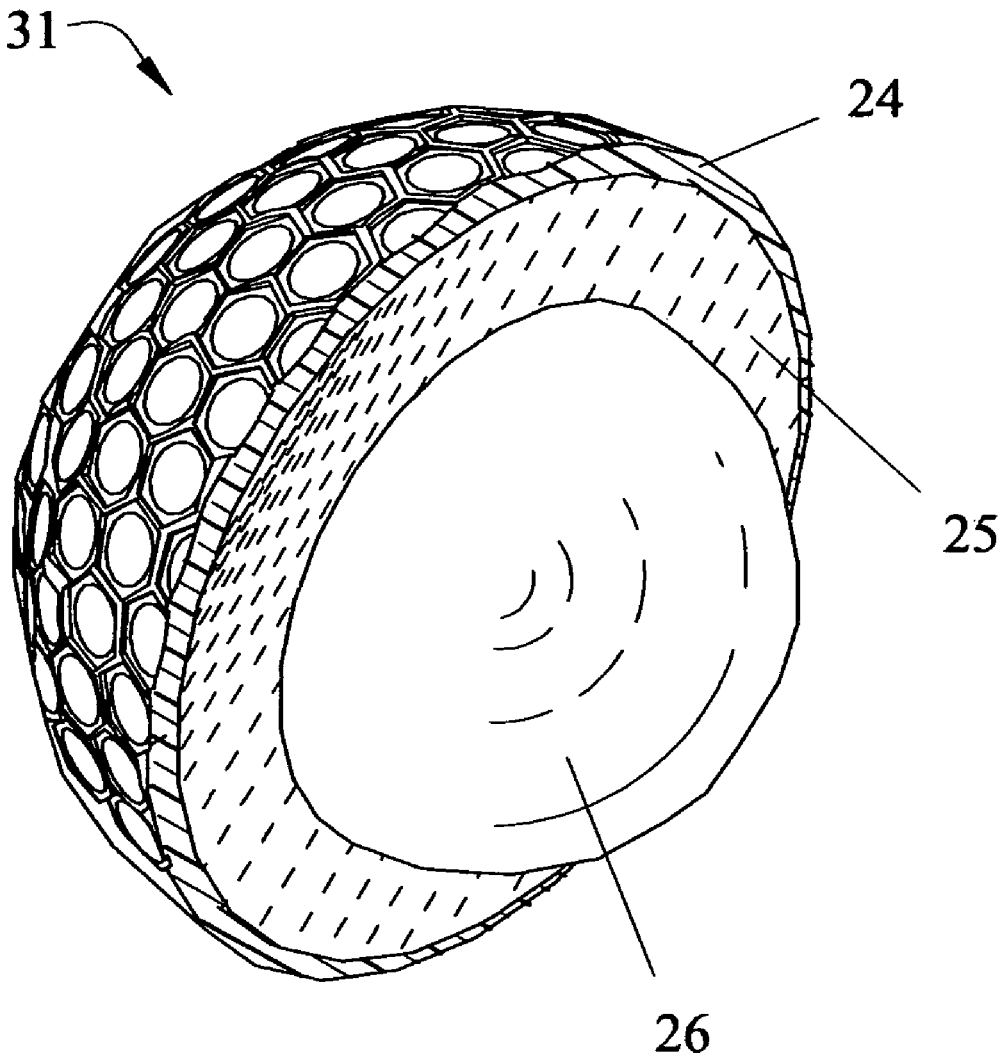
FIG. 5 is a cutaway view of the golf ball of the present invention.

FIG. 5 shows a cutaway view of the golf ball 31 of the present invention which shows a hard outer dimpled surface about an insulated polymer outer shell 24. The polymer can be made of any material which has superior tensile strength and can be easily manufactured at a competitive price. This material includes any synthetic plastic including polyurea, polyurethane, polyurethane-ionomer, polyurea/polyurethane blends or mixtures thereof. An inner metallic core 26 is positioned within the outer shell 24 and a liquid balancing fluid 25 is positioned therearound. The inner metallic core 26 can be made of any metallic material having magnetic, ferromagnetic or paramagnetic properties. The balancing fluid 25 can be any liquid such as water, gels, oils and mixtures thereof which would provide a smooth roll to the golf ball.

| NUMERALS | |
|---|---|
| 1 | standing area |
| 2 | artificial grass putting surface |
| 3 | return channel |
| 4 | cup |
| 5 | gear box |
| 6 | drive rod |
| 7 | treadmill belt |
| 8 | air bladders |
| 9 | sequencing relay module |
| 10-14 | electromagnetic coils |
| 16 | first electrical on/off switch |
| 17 | conduit means |
| 18 | power supply |
| 19 | second electrical on/off switch |
| 20 | air distribution means |
| 21 | magnetic strips |
| 22 | electromagnetic coil |
| 23 | mini air compressor |
| 24 | dimpled polyurethane cover |
| 25 | balancing fluid |
| 26 | metallic core |
| 27 | putting device |
| 28 | putting device with conveyor |
| 29 | putting device with electromagnetic coil |
| 30 | putting device with sequencing relay module |
| 31 | golf ball |

Operation

The putting device of the present invention overcomes the many shortcomings of the prior art. Said invention allows the golfer to continue putting after each practice putt whether the putt is made or missed. The golf ball is directed to the return channel in either case. A permanent magnet could be provided at the return channel's proximal end in order to aid in the gravity return. Although the illustrated invention is for a right handed golfer, said invention could be designed for a left handed golfer also. It would merely require the reversal of parts. The standing area 1 and the return channel 3 could easily be interchanged by providing metal tabs on the edges of the platform 2 with matching holes on the edges of the standing area 1 and the return channel 3. As the golfer putts the golf ball and makes the putt the golf ball will be directed to the return channel 3 to a point adjacent to the standing area 1. If the golfer misses the putt, then the electromagnetic feature of the instant invention directs the golf ball to the return channel 3 and then on to the golfer by merely pressing the first foot actuated electric on/off switch 16 which energizes the electromagnetic means. Said invention also provides for the concept of providing undulations in the simulated putting surface. These undulations can be changed by the golfer pressing the second foot operated electric on/off switch 19 which energizes a mini-compressor 23 which directs air to the bladders 8 below the putting surface. These air bladders, mini-compressors and electric switches are all stock items and their design and implementation are well within the purview of a skilled artisan. It is to be understood that this feature although illustrated in FIG. 3 can easily be adapted to the embodiments set forth in FIGS. 2 and 4. The power supply for the practice putting device is a standard plug in cord to a standard 110 volt A/C outlet or in the alternative a standard battery pack.

The sequencing relay module 9 can be any stock item available that can control the sequential energizing of the electromagnetic coils 1014. One well known unit is the SC-410 Series Sequencing Relay Module manufactured by Space Age Electronics of Marlboro, Mass.

The invention claimed is:

1. A device for practicing putting a golf ball with means for automatic return of every golf ball wherein golfers do not have to move from their original putting position to retrieve every golf ball comprising:

a platform with a synthetic matting positioned thereon simulating a putting surface, said platform containing a cup for receiving the golf ball and a standing area for golfers to establish their putting stance, a return channel having proximal and distal ends and said return channel being in contiguous juxtaposition with said platform, first means for directing the golf ball to the return channel from the cup when a putt enters the cup, and second means positioned below said platform for directing the golf ball to said return channel when the putt remains on the putting surface;

wherein the golf ball is made of material that is attracted to a magnetic field, wherein said first means comprises a conduit connecting said cup to said return channel wherein the golf ball travels from the cup through said conduit to said proximal end of said return channel adjacent said standing area when the putt enters the cup;

wherein said second means includes at least one movable belt positioned below the simulated putting surface with magnetic material positioned thereon and a first foot actuated electric on/off switch located on the standing area for moving the belt and directing the golf ball to the return channel when the putt remains on the putting surface.

2. The device of claim 1, further including means to create undulations in the putting surface.

3. the device of claim 2, wherein said means to create undulations in the putting surface includes a plurality of air bladders positioned below the putting surface and a second foot actuated electric on/off switch for operating a mini-compressor for inflating said air bladders.

4. the device of claim 1, wherein the golf ball comprises a dimpled polymer outer shell surrounding a metallic inner core and a liquid balancing medium positioned within said outer shell and about said inner core;

wherein the material of the inner core is selected from the group consisting of a magnetic material, paramagnetic material, and ferromagnetic material;

wherein the liquid balancing medium is selected from the group consisting of water, gels, oils and mixtures thereof;

wherein the polymer is a member of the group consisting of polyurea, polyurethane, polyurethane-ionomer, polyurethane/polyurea blend and mixtures thereof.

5. A device for practicing putting a golf ball with means for automatic return of every golf ball wherein golfers do not have to move from their original putting position to retrieve every golf ball comprising:

a platform with a synthetic matting positioned thereon simulating a putting surface, said platform containing a cup for receiving the golf ball and a standing area for golfers to establish their putting stance, a return channel having proximal and distal ends and said return channel being in contiguous juxtaposition with said platform, first means for directing the golf ball to the return channel from the cup when a putt enters the cup, and second means positioned below said platform for directing the golf ball to said return channel when the putt remains on the putting surface;

wherein the golf ball is made of material that is attracted to a magnetic field, wherein said first means comprises a conduit connecting said cup to said return channel wherein the golf ball travels from the cup through said conduit to said proximal end of said return channel adjacent said standing area when the putt enters the cup;

wherein said second means comprises an electromagnet positioned within the return channel and a first foot actuated electric on/off switch located on the standing area and upon actuation of the electromagnet the golf ball is directed to the return channel when the putt remains on the putting surface.

6. The device of claim 5, further including means to create undulations in the putting surface.

7. The device of claim 6, wherein said means to create undulations includes a plurality of air bladders positioned below the putting surface and a second foot actuated electric on/off switch for operating a mini-compressor for inflating said air bladders.

8. the device of claim 5, wherein the golf ball comprises a dimpled polymer outer shell surrounding a metallic inner core and a liquid balancing medium positioned within said outer shell and about said inner core;

wherein the material of the inner core is selected from the group consisting of a magnetic material, paramagnetic material, and ferromagnetic material;

wherein the liquid balancing medium is selected from the group consisting of water, gels, oils and mixtures thereof;

wherein the polymer is a member of the group consisting of polyurea, polyurethane, polyurethane-ionomer, polyurethane/polyurea blend and mixtures thereof.

9. A device for practicing putting a golf ball with means for automatic return of every golf ball wherein golfers do not have to move from their original putting position to retrieve every golf ball comprising:

a platform with a synthetic matting positioned thereon simulating a putting surface, said platform containing a cup for receiving the golf ball and a standing area for golfers to establish their putting stance, a return channel having proximal and distal ends and said return channel being in contiguous juxtaposition with said platform, first means for directing the golf ball to the return channel from the cup when a putt enters the cup, and second means positioned below said platform for directing the golf ball to said return channel when the putt remains on the putting surface;

wherein the golf ball is made of material that is attracted to a magnetic field, wherein said first means comprises a conduit connecting said cup to said return channel wherein the golf ball travels from the cup through said conduit to said proximal end of said return channel adjacent said standing area when the putt enters the cup;

wherein said second means comprises a plurality of electromagnetic coils positioned below the putting surface and means to sequentially energize said plurality of electromagnetic coils to direct the golf ball to the return channel when the putt remains on the putting surface.

10. The device of claim 9, wherein the means to sequentially energize said plurality of electromagnetic coils includes a sequencing relay module connected to a first foot actuated electric on/off switch.

11. The device of claim 10, wherein further including means to create undulations in the putting surface.

12. the device of claim 11, wherein said means to create undulations includes a plurality of air bladders positioned below the putting surface and a second foot actuated electric on/off switch operating a mini-compressor for inflating said air bladders.

13. the device of claim 9, wherein the golf ball comprises a dimpled polymer outer shell surrounding a metallic inner core and a liquid balancing medium positioned within said outer shell and about said inner core;

wherein the material of the inner core is selected from the group consisting of a magnetic material, paramagnetic material, and ferromagnetic material;

wherein the liquid balancing medium is selected from the group consisting of water, gels, oils and mixtures thereof;

wherein the polymer is a member of the group consisting of polyurea, polyurethane, polyurethane-ionomer, polyurethane/polyurea blend and mixtures thereof.

* * * * *